United States Patent [19]

Trinkwalder

[11] 4,152,848

[45] May 8, 1979

[54] LIFE SUPPORT TRAINING DEVICE

[75] Inventor: Joseph C. Trinkwalder, North Tonawanda, N.Y.

[73] Assignee: Sherwood-Selpac Corporation, Lockport, N.Y.

[21] Appl. No.: 891,592

[22] Filed: Mar. 30, 1978

[51] Int. Cl.[2] ..... B63C 11/12

[52] U.S. Cl. ..... 35/29 B; 128/142 R

[58] Field of Search ..... 35/29 R, 29 B; 128/142 R, 142.2

[56] References Cited

U.S. PATENT DOCUMENTS

| | | | |
|---|---|---|---|
| 3,224,409 | 12/1965 | Fenger | 128/142.2 UX |
| 3,508,542 | 4/1970 | Browner | 128/142.2 |
| 3,524,444 | 8/1970 | Ellard | 128/142 R |
| 3,591,343 | 7/1971 | McGoff | 23/281 |
| 3,710,809 | 1/1973 | Brown | 137/1 |

FOREIGN PATENT DOCUMENTS

| | | | |
|---|---|---|---|
| 6501272 | 8/1965 | Netherlands | 128/142.2 |

*Primary Examiner*—Harland S. Skogquist

*Attorney, Agent, or Firm*—Christel, Bean & Linihan

[57] ABSTRACT

This invention relates to a training device to be used in conjunction with conventional scuba diving equipment. Such scuba diving equipment includes a pressure regulator for controlling the pressure of breathing air supplied therethrough from an air tank to a user. Various types of warning devices are used to sense the pressure in the air tank and to generate a warning signal (visual or audible, for example) to warn the user when the pressure in the tank reaches a predetermined minimum level. The present invention discloses a device whereby an individual being trained in the use of scuba diving equipment may be provided with breathing air for only a relatively short period of time prior to experiencing a warning signal with respect to his air supply pressure having reached a predetermined minimum level.

5 Claims, 3 Drawing Figures

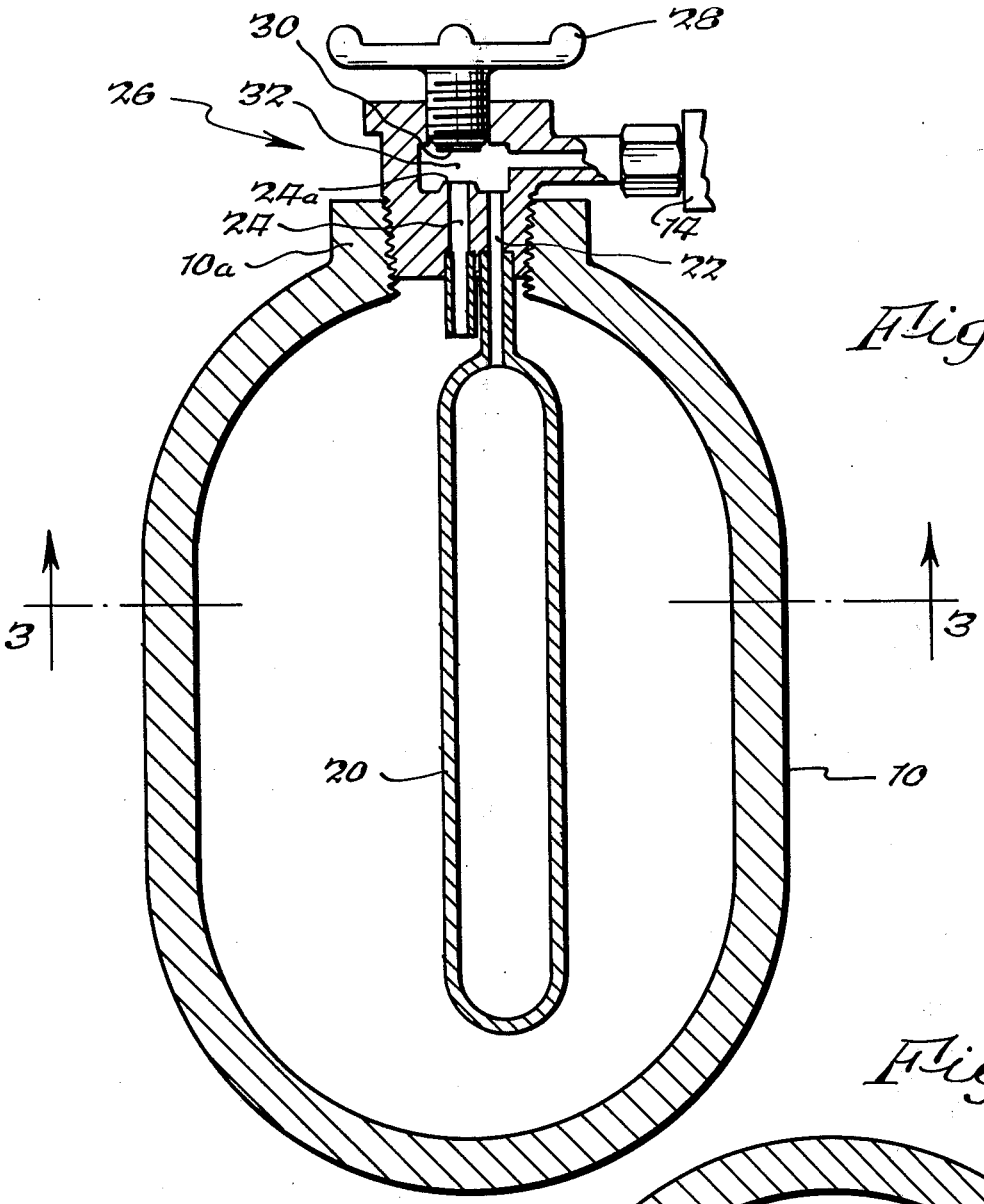
Fig. 2.
Fig. 3.
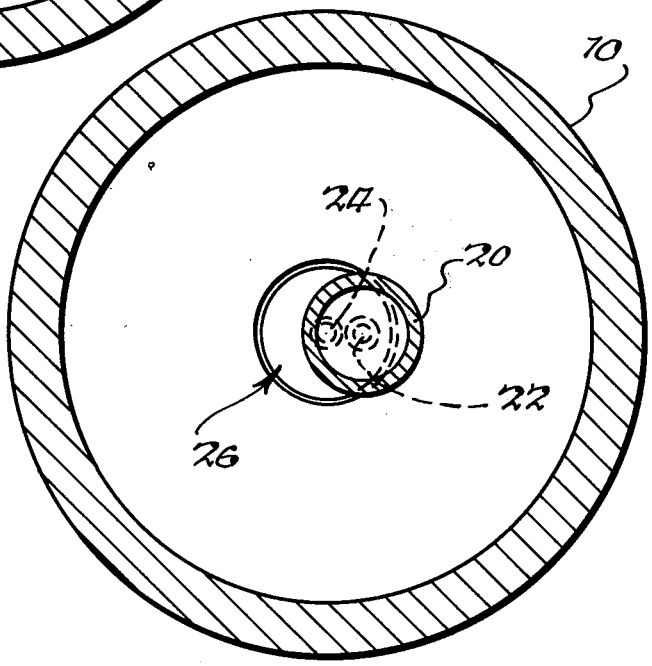
Fig. 1.
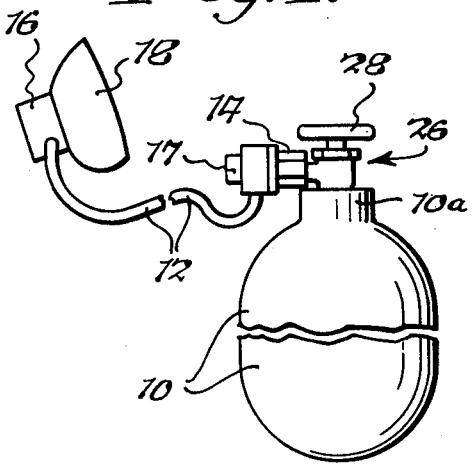

LIFE SUPPORT TRAINING DEVICE

BACKGROUND OF THE INVENTION

This invention relates generally to scuba diving equipment or apparatus and more particularly to pressure regulators/compressed breathing air tanks used in conjunction with training individuals in the use of underwater breathing apparatus.

Within the past several decades, the sport of skin-diving has enjoyed considerable popularity, so that today there exists an entire industry for supplying equipment for this sport. This industry manufactures and sells a wide variety of instruments, devices and equipment to enable a person to properly breathe underwater so as to enable him to remain beneath the surface for extended periods of time.

It is of course necessary for users of such underwater breathing apparatus to undergo a certain degree of training. In this regard, it is conventional to provide a compressed breathing air tank which supplies breathing air to a pressure regulator, the latter in turn supplying breathing air at a constant pressure level to a user of the equipment. It is known to incorporate therewith warning devices which sense the pressure in the air tank or at the input side of the pressure regulator so as to generate a signal (visual or audible, for example) when the pressure level in the air tank reaches a predetermined minimum level — for the purpose of affirmatively informing the user of the equipment that his air supply is about to be depleted.

In training a user of underwater breathing equipment, it is of course important tht such user experience the warning signals as referred to hereinabove prior to completion of his training period. The difficulty encountered in this regard resides in the fact that standard air tanks used in scuba diving equipment are of such a size and pressurized to such a degree as to confine enough air to sustain a user for a substantial duration of time — and during training exercises it is not convenient to wait until a standard air tank becomes sufficiently depleted to generate a warning signal.

SUMMARY OF THE INVENTION

Accordingly, the principal object of the present invention is to provide a training device to be used preferably in conjunction with a standard air tank and pressure regulator for use in scuba diving whereby a user thereof undergoing a training exercise may readily experience a warning signal generated by the depletion of his supply pressure to a predetermined level without having to wait to consume the pressurized breathing air within a standard air tank.

Another object of the present invention is to provide the aforesaid training device which may be used in conjunction with existing scuba diving equipment and which may be readily removed when a user of the scuba diving equipment is not undergoing training with respect to the warning signal generated when his supply pressure falls to a predetermined minimum level.

In summary, the present invention in a preferred embodiment provides a relatively small air tank which is charged with breathing air from a standard scuba air tank while being used independently thereof to supply a pressure regulator in conventional scuba diving equipment. In this embodiment, the small air tank is mounted within a standard air tank in a generally concentric manner by suspending the small tank from a charging valve disposed within the mouth of a standard air tank. The charging valve selectively controls fluid communication between the standard air tank and the small air tank for charging the latter with breathing air. It is conventional practice to have warning means associated with the scuba diving apparatus for monitoring the supply pressure provided to the pressure regulator means so that when the supply pressure falls to a predetermined minimum level, the warning means generates a signal (e.g. visible or audible) to affirmatively indicate to the user of the equipment that his supply pressure has reached such predetermined minimum level. The principal advantage of the present invention resides in the fact that a trainee and his instructor, potentially, do not have to wait a substantial duration of time for the pressure in a standard air tank to fall to a predetermined level so as to generate a warning signal. In using the relatively small tank of the present invention, the breathing air pressure therein decreases more readily than in a standard air tank due to its proportionately smaller volume.

The foregoing and other objects, advantages and characterizing features of the present invention will become clearly apparent from the ensuing description of an illustrative embodiment thereof, taken together with the accompanying drawings wherein like reference characters denote like parts throughout the various views.

BRIEF DESCRIPTION OF THE DRAWINGS

FIG. 1 is an elevational view in fragmentary form illustrating the principal components of the conventional scuba diving equipment used in conjunction with the instant invention;

FIG. 2 is an elevational view in section of a conventional scuba air tank illustrating the charging valve and relatively small tank of the instant invention supported therefrom; and FIG. 3 is a transverse view partly in section, taken about on line 3—3 of FIG. 2 illustrating the generally concentric disposition of the small tank of the instant invention with respect to a standard air tank.

DETAILED DESCRIPTION OF A PREFERRED EMBODIMENT

Referring now in detail to the illustrative embodiment, depicted in the accompanying drawings, there is shown in FIG. 1 a conventional compressed air breathing tank 10, in fragmentary form, as used by scuba divers and which includes the training device as described in detail hereinbelow. A supply hose 12 shown in fragmentary form, connects the first stage regulator 14 with a demand regulator means 16, to supply pressurized air from tank 10 to the users mask 18. The first stage regulator 14 supplies an intermediate air pressure to the demand regulator 16 which in turn delivers air, on demand, to the user's face mask 18. A warning means 17 is included in the first stage regulator 14 to monitor the input pressure thereto, and necessarily the pressure in the tank 10. Such a warning means generates a signal (such as an audible, visual or restrictive breathing) when the pressure on the input side of the regulator 14 falls to a predetermined minimum level so that the user of the apparatus will be affirmatively warned of such a pressure level condition. The apparatus so described in FIG. 1 is well known in the prior art.

Turning now to the specific subject matter of the instant invention, reference will be made to FIGS. 2 and 3. As stated, air tank 10 is of a conventional, known construction being relatively large and adapted to normally confine compressed breathing air in an amount sufficient to sustain a user thereof for a substantial period of time. Supply pressures on the order of 200 to 4,000 psi may be provided to the input side of a pressure regulator as referred to hereinabove. In other words, the supply pressure undergoes a considerable decrease as the breathing air is consumed and a user thereof is affirmatively warned of this fact at a certain point in time as referred to hereinabove. As stated, the principal object of the present invention is to decrease what would normally be a substantial duration of time for an air tank to be depleted to a level such that the warning means would be activated so as to facilitate the training of an individual user; it being undesirable to have the trainee and potentially his instructor wait a long period of time for the trainee to experience the operation of the warning means.

Accordingly, a relatively small tank 20, in comparison to tank 10, is mounted within tank 10 and adapted to confine compressed breathing air in an amount sufficient to sustain a user thereof for only a predetermined, limited duration of time in comparison to tank 10. Tank 20 and tank 10 are connected together in fluid communication by passages 22 and 24 disposed in the housing of a charging valve means 26. Although in FIG. 2, the longitudinal axis of the small tank 20 is offset slightly from the corresponding axis of tank 10, the small tank 20 is suspended generally in a concentric manner with respect to the conventional tank 10.

The charging valve means 26 includes a selectively movable valve handle 28/valve portion 30 for engagement against the valve seat portion 24*a* associated with passage 24. With the handle 28/valve 30 in a raised position as shown in FIG. 2, pressurized breathing air from tank 10 is free to flow upwardly through passage 24 into the valve chamber 32 and downwardly through passage 22 into the small training tank 20. Of course, when the handle 28/valve 30 are lowered downwardly to seal against the valve seat 24*a*, the fluid communication between tanks 10 and 20 is closed off. Necessarily, the training tank 20 as shown, would remain in open communication with the nozzle portion 14 of the charging valve which in turn would be in communication with the supply hose 12. As further illustrated in FIG. 2, the integral subassembly of the charging valve 26, as including the passages 22 and 24 and the tank 20 suspended therefrom, may be removed as a unit by disengaging the housing of the charging valve 26 from its threaded connection with the inner surface of the mouth portion 10*a* of tank 10. In this manner, a conventional air tank 10 may be easily modified to include the relatively small tank 20 and the charging valve 26 associated therewith.

In operation, a standard air tank 10 receives the housing of charging valve 26 and the training tank 20. After an initial charging of the tanks 10 and 20 through nozzle 14, for example, with the valve 22 in a raised disposition, the same could be engaged against valve seat 24*a* so as to close off the open communication between the tanks 10 and 20.

Once the face mask 18 is donned and consumption of breathing air through the demand regulator 16 commences, the predetermined pressure level at which the aforesaid warning means will be activated is much more quickly reached through use of tank 20 than if the standard air tank 10 were used due to the considerably smaller volume of tank 20 in comparison to tank 10. Accordingly, a trainee may submerge below water and breathe air supplied by tank 20 and in short time experience the warning signal generated as the pressure in tank 20 decreases. In addition, the training tank 20 can easily be recharged by simply lifting the valve 30 upwardly, allowing tank 20 to communicate with tank 10 until equilibrium is reached, and then close off the communication again therebetween.

From the foregoing, it is apparent that the objects of the present invention have been fully accomplished. Through use of the training tank 20, a user can quickly experience the warning signal which would be generated when a larger conventional tank 10 would deplete to a predetermined minimum pressure level. Necessarily, it is also contemplated that a relatively small training tank such as 20 could be designed to be mounted outside of a conventional tank 10 and operate in the general manner described hereinabove.

Having thus described and illustrated a preferred embodiment of my invention, it will be understood that such description and illustration is by way of example only and that such modifications and changes as may suggest themselves to those skilled in the art are intended to fall within the scope of the present invention as limited only by the appended claims.

I claim:

1. A life support system for training users of compressed breathing air apparatus, said system comprising:

a relatively large tank adapted to confine compressed breathing air in an amount sufficient to sustain a user thereof for a substantial period of time, a relatively small tank adapted to confine compressed breathing air in an amount sufficient to sustain a user thereof for only a pre-determined, limited duration of time in comparison to said large tank, means connecting said large and small tanks together in fluid communication with one another, a charging valve means being operatively disposed between said large and small tanks for selectively controlling the fluid communication therebetween so that said small tank can be selectively charged with breathing air from said large tank and thereafter used independently of said large tank, a pressure regulator means in fluid communication with at least said small tank, said pressure regulator means controlling the pressure of breathing air supplied to a user of said life support system from said small tank, and warning means in fluid communication with at least said small tank for monitoring the pressure therein so that when the pressure in said small tank falls to a pre-determined level, a user of said life support system will be warned of such pressure level condition whereby a user being trained with respect to the operation of said compressed breathing air apparatus may experience the operation of said warning means within a relatively shorter period of time through use of only said small tank than if said large tank were used for training purposes.

2. A life support system for training users of compressed breathing air apparatus as set forth in claim 1 wherein said small tank is disposed within said large tank.

3. A life support system for training users of compressed breathing air apparatus as set forth in claim 2 wherein said means connecting said tanks in fluid communication with one another and said charging valve means comprise an integral subassembly reversibly engaged within an opening in the wall of said large tank.

4. A life support system for training users of compressed breathing air apparatus as set forth in claim 3 wherein said small tank is suspended within said large tank from said integral subassembly in a generally concentric disposition with respect to said large tank.

5. A training device adapted for use with compressed breathing air apparatus wherein the apparatus includes a relatively large tank for confining compressed breathing air in an amount sufficient to sustain a user thereof for a substantial period of time, pressure regulator means for controlling the pressure of breathing air supplied therethrugh to a user of the apparatus, means normally connecting said pressure regulator to said large tank, and warning means in fluid communication with the breathing air supplied to said pressure regulator for monitoring the pressure thereof so that when such pressure falls to a predetermined level, a user of the apparatus will be warned of such pressure level condition, said device comprising:

a relatively small tank adapted to confine compressed breathing air in an amount sufficient to sustain a user thereof for only a predetermined, limited duration of time in comparison to the large tank of the breathing air apparatus, means adapted to connect said large and small tanks together in fluid communication with one another, and a charging valve means adapted to be operatively disposed between said large and small tanks for selectively controlling the fluid communication therebetween so that said small tank can be selectively charged with breathing air from said large tank and thereafter used independently of said large tank whereby the latter may be used to supply breathing air to said regulator means for training a user with respect to the operation of said warning means which will become operative within a relatively shorter period of time through use of only said small tank to supply said regulator means than if said large tank were used.

* * * * *